US008905442B2

(12) United States Patent
Ishigami et al.

(10) Patent No.: US 8,905,442 B2
(45) Date of Patent: Dec. 9, 2014

(54) LATCH STRUCTURE AND CABLE WITH CONNECTOR

(75) Inventors: Yoshiaki Ishigami, Hitachi (JP); Kenichi Tamura, Hitachi (JP); Masayuki Nikaido, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 860 days.

(21) Appl. No.: 12/643,358

(22) Filed: Dec. 21, 2009

(65) Prior Publication Data

US 2010/0194119 A1 Aug. 5, 2010

(30) Foreign Application Priority Data

Jan. 30, 2009 (JP) ..... 2009-020716

(51) Int. Cl.

*E05C 19/10* (2006.01)
*H01R 13/639* (2006.01)
*H01R 13/627* (2006.01)

(52) U.S. Cl.

CPC ..... *H01R 13/627* (2013.01); *H01R 13/639* (2013.01); *Y10S 292/63* (2013.01)
USPC .... 292/128; 292/228; 292/304; 292/DIG. 63; 439/352

(58) Field of Classification Search

USPC ..... 398/135–139; 439/155, 160, 350, 352, 439/358, 752; 292/101, 107, 108, 120, 128, 292/80, 87, 89, 91, 213, 218, 228, 303, 304, 292/DIG. 30, DIG. 61, DIG. 63
See application file for complete search history.

(56) References Cited

U.S. PATENT DOCUMENTS

| | | | | | |
|---|---|---|---|---|---|
| 1,899,360 | A | * | 2/1933 | Roudebush et al. | 439/358 |
| 4,726,783 | A | * | 2/1988 | Nakazawa et al. | 439/350 |
| 5,011,425 | A | * | 4/1991 | Van Zanten et al. | 439/353 |
| 5,340,329 | A | * | 8/1994 | Hirai | 439/357 |
| 5,383,794 | A | * | 1/1995 | Davis et al. | 439/352 |
| 5,713,752 | A | * | 2/1998 | Leong et al. | 439/358 |
| 5,741,150 | A | * | 4/1998 | Stinson et al. | 439/358 |
| 5,788,528 | A | * | 8/1998 | Orr et al. | 439/358 |

(Continued)

FOREIGN PATENT DOCUMENTS

| | | |
|---|---|---|
| JP | 2004-311207 | 11/2004 |
| JP | 2004-343506 | 12/2004 |

*Primary Examiner* — Kristina Fulton
*Assistant Examiner* — Alyson M Merlino
(74) *Attorney, Agent, or Firm* — Scully, Scott, Murphy & Presser, P.C.

(57) ABSTRACT

A latch structure according to an embodiment includes a cage having an engagement hole, a connector attachably and detachably held in the cage, the connector comprising a connector body having an almost rectangular parallelepiped shape and an insertion part to be inserted into the cage formed on an end surface of the connector body, a latch cover rockably installed in an upper surface of the connector body, being formed of a single plate material and having a cover body for covering the upper surface of the connector body, an engagement claw to engage with the engagement hole of the cage formed at an end portion of the latch cover, a spring member for always energizing the latch cover so that the engagement claw engages with the engagement hole, a rocking member formed in both sides of the cover body of the latch cover and formed by bending the plate material downward and a rocking groove formed in both side surfaces of the connector body for rockably engaging with the rocking member, wherein the rocking member is fitted to the rocking groove and the latch cover is rockably installed in the connector body.

10 Claims, 11 Drawing Sheets

60 CABLE WITH CONNECTOR
61 PLATE SPRING
62 LATCH STRUCTURE

(56) References Cited

U.S. PATENT DOCUMENTS

| | | | | |
|---|---|---|---|---|
| 5,820,398 | A * | 10/1998 | Stabroth et al. | 439/352 |
| 5,860,826 | A * | 1/1999 | Chang | 439/358 |
| 6,149,451 | A * | 11/2000 | Weber | 439/358 |
| 6,210,202 | B1 * | 4/2001 | Kuo | 439/358 |
| 6,217,364 | B1 * | 4/2001 | Miskin et al. | 439/358 |
| 6,234,828 | B1 * | 5/2001 | Kuo | 439/358 |
| 6,322,387 | B2 * | 11/2001 | Kawamae et al. | 439/358 |
| 6,371,788 | B1 * | 4/2002 | Bowling et al. | 439/358 |
| 6,439,918 | B1 * | 8/2002 | Togami et al. | 439/372 |
| 6,533,603 | B1 * | 3/2003 | Togami | 439/372 |
| 6,538,882 | B2 * | 3/2003 | Branch et al. | 361/679.02 |
| 6,666,484 | B1 | 12/2003 | Branch et al. | |
| 6,726,501 | B2 * | 4/2004 | Waddell et al. | 439/352 |
| 6,746,264 | B1 * | 6/2004 | Branch et al. | 439/352 |
| 6,860,750 | B1 * | 3/2005 | Wu | 439/358 |
| 6,890,205 | B1 * | 5/2005 | Wu | 439/358 |
| 7,066,746 | B1 * | 6/2006 | Togami et al. | 439/157 |
| 7,118,281 | B2 * | 10/2006 | Chiu et al. | 385/53 |
| 7,134,914 | B1 * | 11/2006 | Wu | 439/607.41 |
| 7,186,134 | B2 * | 3/2007 | Togami et al. | 439/484 |
| 7,226,307 | B1 * | 6/2007 | Chen et al. | 439/352 |
| 7,354,292 | B1 * | 4/2008 | Lloyd et al. | 439/352 |
| 7,364,446 | B2 * | 4/2008 | Kurashima | 439/157 |
| 7,445,484 | B2 * | 11/2008 | Wu | 439/352 |
| 7,476,117 | B1 * | 1/2009 | Chen et al. | 439/352 |
| 7,534,125 | B1 * | 5/2009 | Schroll | 439/352 |
| 7,572,138 | B1 * | 8/2009 | Wu | 439/352 |
| 7,654,849 | B2 * | 2/2010 | Gordon et al. | 439/350 |
| 7,666,023 | B2 * | 2/2010 | Wu | 439/352 |
| 7,736,171 | B2 * | 6/2010 | Reed et al. | 439/352 |
| 2002/0072267 | A1 * | 6/2002 | Bowling et al. | 439/358 |
| 2003/0049000 | A1 | 3/2003 | Wu | |
| 2004/0228582 | A1 | 11/2004 | Yamada et al. | |
| 2005/0196109 | A1 * | 9/2005 | Kim et al. | 385/92 |
| 2007/0149005 | A1 * | 6/2007 | Togami et al. | 439/76.1 |

* cited by examiner

1 CABLE WITH CONNECTOR
2 CONNECTOR BODY
3 INSERTION PART
4 CONNECTOR
5 CABLE
6 LATCH STRUCTURE
7 LATCH COVER
8 ENGAGEMENT CLAW
9 COVER BODY
10 ROCKING MEMBER
13 ROCKING GROOVE

1 CABLE WITH CONNECTOR
2 CONNECTOR BODY
3 INSERTION PART
4 CONNECTOR
5 CABLE
6 LATCH STRUCTURE
7 LATCH COVER
8 ENGAGEMENT CLAW
9 COVER BODY
10 ROCKING MEMBER
13 ROCKING GROOVE
21 COIL SPRING

1 CABLE WITH CONNECTOR
2 CONNECTOR BODY
3 INSERTION PART
4 CONNECTOR
5 CABLE
6 LATCH STRUCTURE
7 LATCH COVER
8 ENGAGEMENT CLAW
9 COVER BODY
10 ROCKING MEMBER
13 ROCKING GROOVE
31 CAGE

1 CABLE WITH CONNECTOR
2 CONNECTOR BODY
3 INSERTION PART
4 CONNECTOR
5 CABLE
6 LATCH STRUCTURE
7 LATCH COVER
8 ENGAGEMENT CLAW
9 COVER BODY
10 ROCKING MEMBER
13 ROCKING GROOVE
31 CAGE

2 CONNECTOR BODY
6 LATCH STRUCTURE
7 LATCH COVER
9 COVER BODY
10 ROCKING MEMBER
13 ROCKING GROOVE
16 ROCKING RESTRICTION PART

60 CABLE WITH CONNECTOR
61 PLATE SPRING
62 LATCH STRUCTURE

70 CABLE WITH CONNECTOR
61 PLATE SPRING
71 LATCH STRUCTURE
72 PLATE WITH SLIP STOPPER

80 CABLE WITH CONNECTOR
61 PLATE SPRING
81 PLATE SPRING HOUSING GROOVE
82 LATCH STRUCTURE

91 SLIT
13 ROCKING GROOVE

102 STOPPER MECHANISM
103 STOPPER GROOVE
104 PLATE SPRING

15 GROOVE FOR PIVOT
102 STOPPER MECHANISM
103 STOPPER GROOVE
104 PLATE SPRING

125 LATCH STRUCTURE
127 COVER
128 ENGAGEMENT CLAW
129 LEVER PART
131 CONVEX PART

PRIOR ART

LATCH STRUCTURE AND CABLE WITH CONNECTOR

The present application is based on Japanese patent application No. 2009-020716 filed on Jan. 30, 2009, the entire contents of which are incorporated herein by reference.

BACKGROUND OF THE INVENTION

1. Field of the Invention

This invention relates to a latch structure attachably and detachably holding a connector in the cage and a cable with connector.

2. Description of the Related Art

Recently, in accordance with speeding up of communication, a next generation I/O interface (I/O architecture) such as InfiniBand and PCI Express (which are registered trademarks in USA) is put to practical use. In the InfiniBand and PCI Express, high speed band frequency is realized by using a plurality of channels which are bundled.

In a connector used for the InfiniBand and PCI Express, the shape and dimension thereof are defined in accordance with the connection type and the number of the channel by a standard called MSA (Multi Source Agreement).

As an example, a cable with connector used for the PCI Express is shown in FIGS. 12A and 12B.

As shown in FIGS. 12A and 12B, the cable with connector 120 includes a connector 121 having a connector body 123 having an almost rectangular parallelepiped shape and an insertion part 124 formed on an end surface of the connector body 123, and a cable (a metal cable) 122 connected to the connector 121.

The cable with connector 120 is electrically connected to a communication device via a cage and a blade by inserting the insertion part 124 of the connector 121 into the cage (not shown) fixed to the blade (a line card) located at the side of the communication device such as a server. A latch structure 125 removably holding the connector 121 in the cage is installed in the connector body 123 of the connector 121.

The conventional latch structure 125 has a structure that a latch removal member 126 is slidably housed in a slide groove 130 formed on the upper surface of the connector body 123 and a cover 127 is installed so as to cover the upside of the latch disengagement member 126.

A engagement claw 128 to engage with an engagement hole formed on an upper surface of the cage from above is formed in an end portion of the cover 127 (right side in FIGS. 12A and 12B), and the rear end portion (left side in FIGS. 12A and 12B) is fixed to the upper surface of the connector body 123.

A convex part 131 having an almost circular arc-like shape on a side view which becomes convex toward a side of the connector body 123 (lower side in FIGS. 12A and 12B) is formed in an end portion of the latch disengagement member 126 (right side in FIGS. 12A and 12B), and the convex part 131 is housed in a convex part housing groove 132 formed in the slide groove 130, the groove 132 having an almost circular arc-like shape on a side view. Also, a lever part 129 is formed in a rear end portion of the latch disengagement member 126 (left side in FIGS. 12A and 12B). The lever part 129 is installed so as to project to rearward of the connector body 123 (left side in FIGS. 12A and 12B).

The conventional latch structure 125 is operable to allow the convex part 131 to be lifted upward along the convex part housing groove 132 by pulling the lever part 129 of the latch disengagement member 126 backward, consequently, the end portion of the cover 127 is lifted upward, and the engagement claw 128 is lifted upward. As just described, the conventional latch structure 125 functions to allow the connector 121 to be attached to and detached from the cage by pulling the lever part 129 of the latch disengagement member 126 backward so as to lift the engagement claw 128 upward.

Further, this technique is disclosed in, for example, JP-A-2004-343506, JP-A-2004-311207, U.S. Pat. No. 6,666,484, and US-A-2003/0049000.

However, since the conventional latch structure 125 has the lever part 129 of the latch disengagement member 126 which is installed so as to project to rearward of the connector body 123, it has a problem that the lever part 129 is complicated in appearance. Particularly, when a plurality of cables with connector 120 are connected to the blade or the like, the lever part 129 of each of the cables with connector 120 projects from a front surface of the blade, so that the appearance becomes extremely complicated.

Also, the conventional latch structure 125 has a problem that the connector 121 is difficult to attach and detach, since it is needed to attach and detach the connector 121 while pulling the lever part 129.

SUMMARY OF THE INVENTION

Therefore, it is an object of the invention to provide a latch structure that is capable of being easily attached and detached and has a good appearance, and a cable with connector.

(1) According to one embodiment of the invention, a latch structure for attachably and detachably holding a connector in a cage, the connector including a connector body having an almost rectangular parallelepiped shape and an insertion part to be inserted into the cage formed on an end surface of the connector body, and the cage having an engagement hole, comprises:

a latch cover rockably installed in an upper surface of the connector body, being formed of a single plate material and having a cover body for covering the upper surface of the connector body;

an engagement claw to engage with the engagement hole of the cage formed at an end portion of the latch cover;

a spring member for always energizing the latch cover so that the engagement claw engages with the engagement hole;

a rocking member formed in both sides of the cover body of the latch cover and formed by bending the plate material downward; and a rocking groove formed in both side surfaces of the connector body for rockably engaging with the rocking member, wherein the rocking member is fitted to the rocking groove and the latch cover is rockably installed in the connector body.

In the above embodiment (1), the following modifications and changes can be made.

(i) The upper surface of the connector body is formed to be diagonally inclined so as to be lowered in height toward a rear end portion of the connector body, and a rocking restriction part for restricting the rocking of the latch cover at the position that the cover body becomes horizontal is formed at the end portion of the upper surface of the connector body.

(ii) The spring member is integrally formed with the cover body and formed of a plate spring energizing upward the cover body located behind the rocking member.

(iii) The rocking member is formed of a circular plate axis to become a rocking axis of the latch cover and a supporting leg connecting the circular plate axis and the latch body, and the rocking groove is formed of an axis groove for rotatably housing the circular plate axis and a groove for pivot for rotatably housing the supporting leg, and the circular plate axis is housed in the axis groove and the supporting leg is housed in the groove for pivot so that the latch cover is rockably installed in the connector body.

(iv) The circular plate axis is formed so as to be eccentric backward to a center axis of the supporting leg and the axis groove is formed so as to be eccentric backward to the groove for pivot, and the groove for pivot is formed to have a width into which the circular plate axis is inserted from above, so that the circular plate axis is housed in the axis groove via the groove for pivot.

(v) The latch structure further comprises a stopper mechanism for holding the circular plate axis of the latch cover in the axis groove.

(vi) The stopper mechanism comprises a stopper groove formed on the upper surface of the connector body and a plate spring integrally formed with the cover body, engaging with the stopper groove so as to latch the latch cover backward and energizing upward the cover body located behind the rocking member.

(2) According to another embodiment of the invention, a cable with a connector comprises:

a connector comprising the latch structure according to the above embodiment (1); and a cable connected to the connector.

ADVANTAGES OF THE INVENTION

According to one embodiment of the invention, a latch structure that is capable of being easily attached and detached and has a good appearance, and a cable with connector can be provided.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1A:
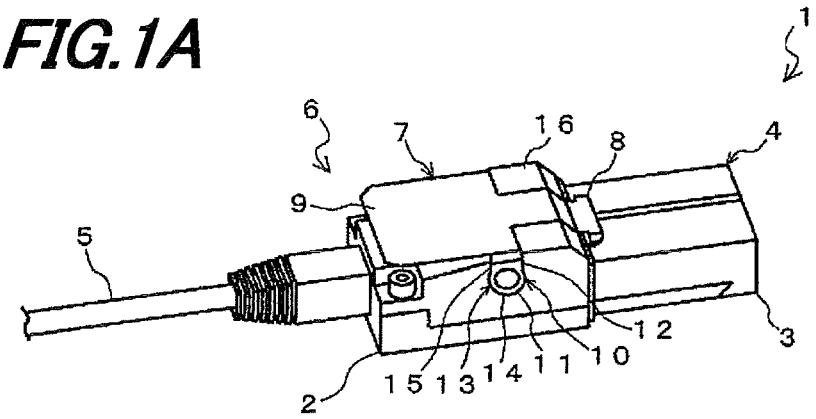
FIG. 1A is a perspective view schematically showing a cable with connector having a latch structure according to one embodiment of the invention.

The preferred embodiments according to the invention will be explained below referring to the drawings.

Figure 1B:
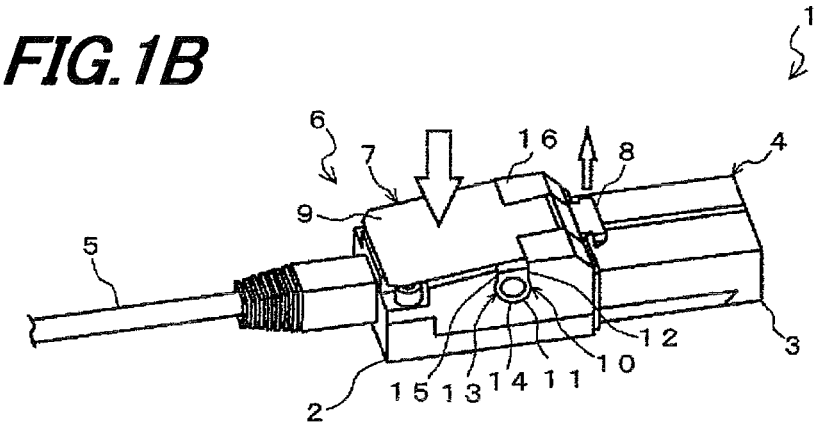
FIG. 1B is a perspective view schematically showing a cable with connector having a latch structure according to one embodiment of the invention.
Figure 2A:
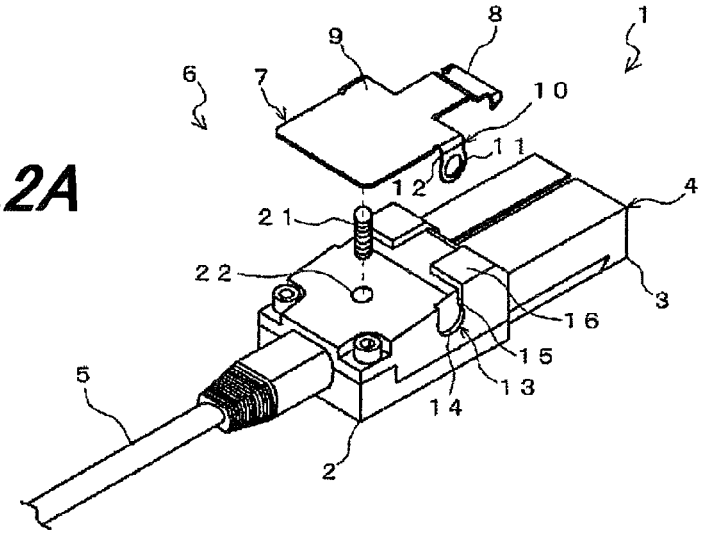
FIG. 2A is an exploded perspective view of the cable with connector shown in FIGS. 1A and 1B.
Figure 2B:
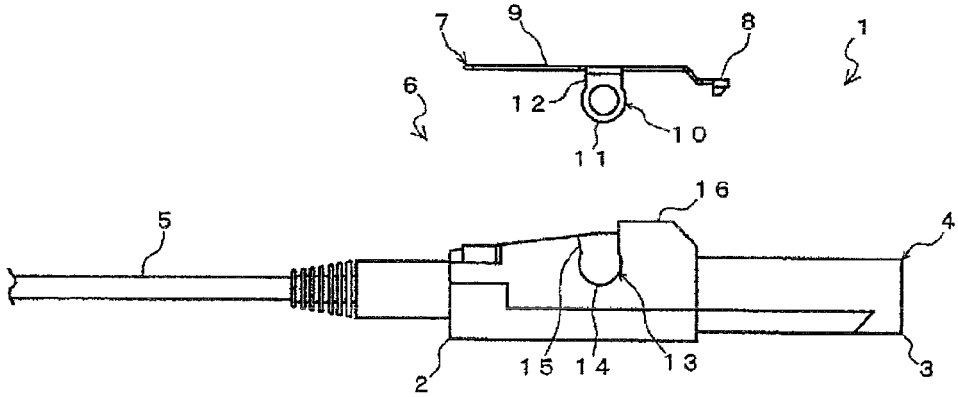
FIG. 2B is an exploded side view of the cable with connector shown in FIGS. 1A and 1B.
Figure 3A:
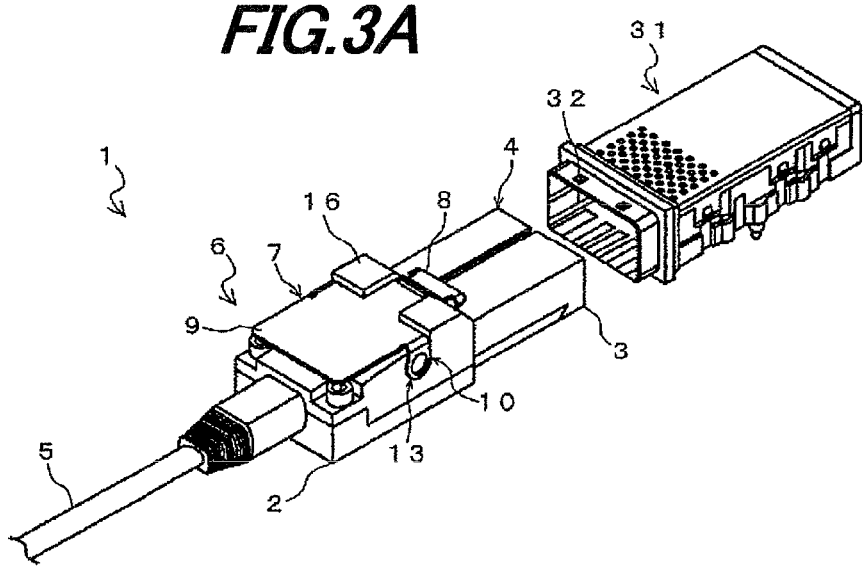
FIG. 3A is a perspective view schematically showing a state that the cable with connector is detached from a cage.
Figure 3B:
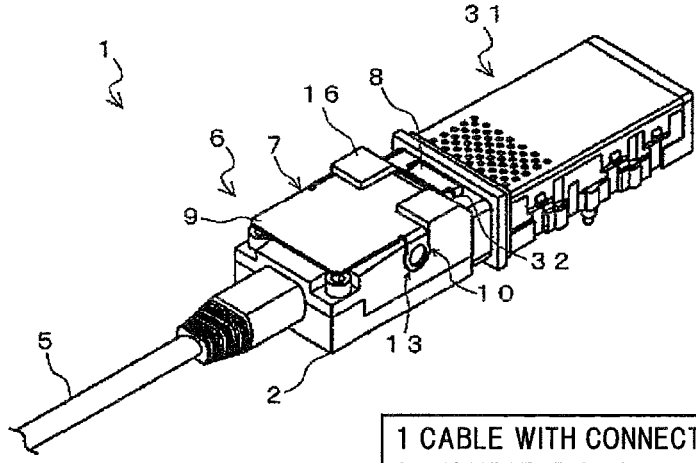
FIG. 3B is a perspective view schematically showing a state that the cable with connector is attached to the cage.

FIG. 1A is a perspective view schematically showing a cable with connector having a latch structure according to one embodiment of the invention, FIG. 1B is a perspective view schematically showing a cable with connector having a latch structure according to one embodiment of the invention, FIG. 2A is an exploded perspective view of the cable with connector shown in FIGS. 1A and 1B, and FIG. 2B is an exploded side view of the cable with connector shown in FIGS. 1A and 1B.

As shown in FIGS. 1A and 1B, and FIGS. 2A and 2B, a cable with connector 1 includes a connector 4 and a cable 5 connected to the connector 4, the connector 4 including a connector body 2 having an almost rectangular parallelepiped shape and an insertion part 3 formed on an end surface of the connector body 2.

Hereinafter, a case that the cable with connector 1 is a cable based on the InfiniBand of 12 channels will be explained. An optical receiver-transmitter is mounted in the connector 4, and 12×2 optical fibers for both of reception and transmittance are connected to the optical receiver-transmitter as a cable 5. The cable with connector 1 is not limited to this, but, for example, it can be a cable based on the PCI Express.

As shown in FIGS. 3A and 3B, and FIGS. 4A and 4B, the insertion part 3 of the connector 4 is inserted and connected to a cage 31 fixed to a blade (line card) of a communication device such as a server (not shown), so that the cable with connector 1 is electrically connected to the communication device via the cage 31 and the blade. Engagement holes 32 are formed in an end portion of an upper surface of the cage 31.

As shown in FIGS. 1A and 1B, FIGS. 2A and 2B, FIGS. 3A and 3B, and FIGS. 4A and 4B, a latch structure 6 according to the embodiment for attachably and detachably holding the connector 4 in the cage 31 is installed in the connector 4 of the cable with connector 1.

The latch structure 6 includes a latch cover 7 rockably installed on the upper surface of the connector body 2, an engagement claw 8 to engage with the engagement hole 32 of the cage 31 formed at an end portion of the latch cover 7 (right side in FIG. 1A), and a coil spring 21 as a spring member for always energizing the latch cover 7 so that the engagement claw 8 engages with the engagement hole 32.

The latch cover 7 includes a cover body 9, the engagement claw 8 and a rocking member 10 extending from both sides of the cover body 9 of the latch cover 7 downward. The rocking member 10 is formed at an end portion side (right side in FIG. 1A) rather than a center portion of the longitudinal direction (right and left direction in FIG. 1A) of the latch cover 7.

The cover body 9, engagement claw 8 and rocking member 10 are integrally formed by fabricating a single plate material, and the rocking member 10 is formed by bending the plate material by almost 90 degrees downward. As the plate material for the latch cover 7, stainless-steel is preferably used.

The rocking member 10 includes a circular plate axis 11 having a circular plate-like shape to be an axis when the latch cover 7 rocks and a supporting leg 12 for combining the circular plate axis 11 and the cover body 9, and is formed so as to have an almost inverted Q shape as a whole.

A rocking groove 13 is formed in both side surfaces of the connector body 2 for rockably engaging the rocking member 10. The rocking groove 13 includes an axis groove 14 for rotatably housing the circular plate axis 11 of the rocking member 10 and a groove for pivot 15 for rotatably housing the supporting leg 12 of the rocking member 10.

In addition, the upper surface of the connector body 2 is formed to be diagonally inclined so as to be lowered in height toward a rear end portion (left side in FIG. 1A) of the connector body 2, and a rocking restriction part 16 for restricting the rocking of the latch cover 7 at the position that the cover body 9 becomes horizontal is formed at the end portion of the upper surface of the connector body 2. Further, a spring member housing hole 22 for housing a coil spring 21 as a spring member is formed on the upper surface of the connector body 2 at the rear of the groove for pivot 15.

The circular plate axis 11 is housed in the axis groove 14 and the supporting leg 12 is housed in the groove for pivot 15 so that the latch cover 7 is rockably installed in the connector body 2. When the latch cover 7 is installed in the connector body 2, it can be adopted that a part of rocking member 10 is expanded, in which state the rocking member 10 is fitted to the rocking groove 13.

The coil spring 21 is housed in the spring member housing hole 22, and always energizes upward the cover body 9 located behind the rocking member 10. Due to this, the engagement claw 8 is always energized downward so as to engage with the engagement hole 32.

Figure 5A:
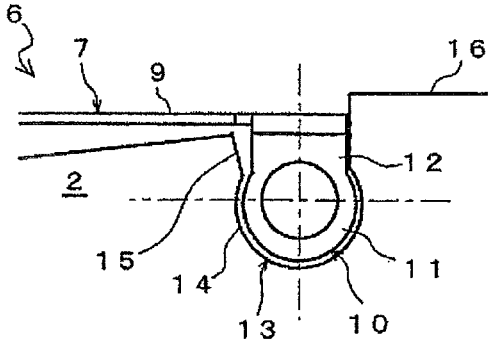
FIG. 5A is an enlarged side view of the primary portion of the cable with connector shown in FIGS. 1A and 1B.

As shown in FIG. 5A, in the latch structure 6, the cover body 9 of the latch cover 7 is always energized upward by the coil spring 21, so that it is always located at the position that the rocking is restricted by the rocking restriction part 16, namely, the cover body 9 becomes horizontal.

Figure 4A:
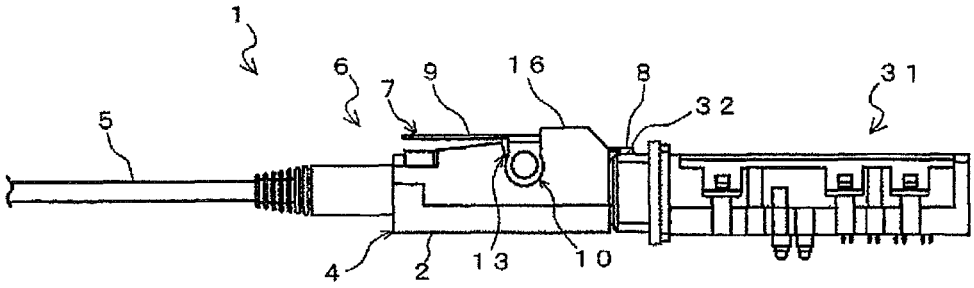
FIG. 4A is a side view schematically showing a state that an engagement claw engages with an engagement hole of the cage.
Figure 4B:
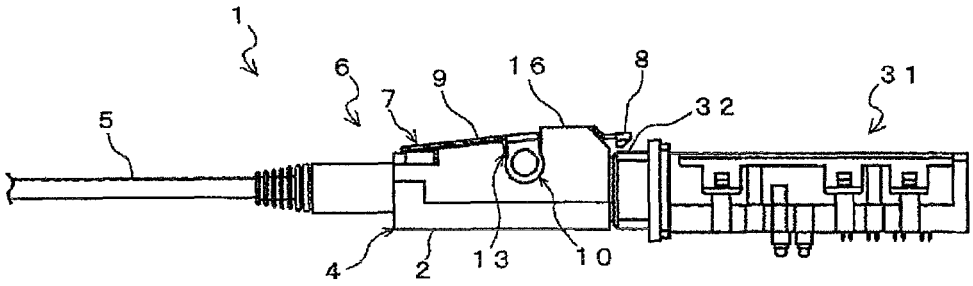
FIG. 4B is a side view schematically showing a state that the engagement claw is released from the engagement hole of the cage.
Figure 5B:
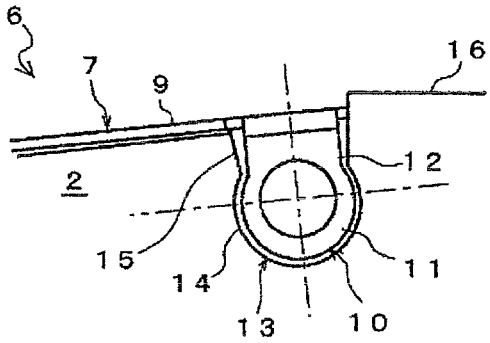
FIG. 5B is an enlarged side view of the primary portion of the cable with connector shown in FIGS. 1A and 1B.

As shown in FIG. 5B, when the cover body 9 of the latch cover 7 is pushed down from above, the latch cover 7 rocks around the circular plate axis 11 (in a counterclockwise direction in FIG. 5B), consequently, the engagement claw 8 is lifted upward (refer to FIGS. 1B and 4B). As just described, in the latch structure 6, the cover body 9 is pushed down from above and the engagement claw 8 is lifted upward, so that the engagement between the engagement claw 8 and the engagement hole 32 can be released and the connector 4 can be attached to and detached from the cage 31.

Hereinafter, an operation of the embodiment will be explained.

In the latch structure 6 according to the embodiment, the latch cover 7 is formed of a single plate material and the rocking member 10 is formed in both sides of the cover body 9 covering the upper surface of the connector body 2 by bending the plate material downward, on the other hand, the rocking groove 13 is formed in both side surfaces of the connector body 2 for rockably engaging with the rocking member 10, and the rocking groove 13 is fitted to the rocking member 10 so that the latch cover 7 is rockably installed in the connector body 2.

Figure 12A:
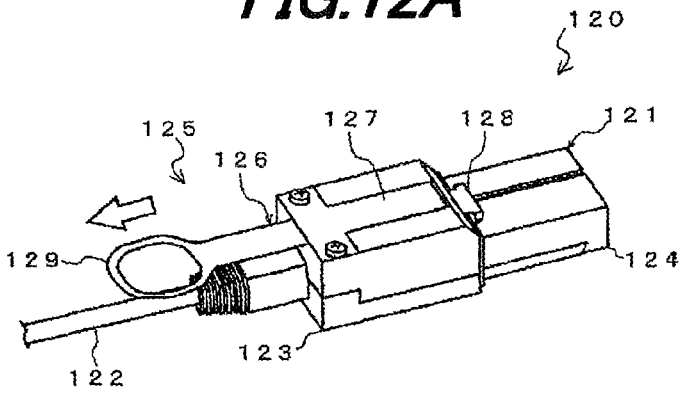
FIG. 12A is a perspective view schematically showing a conventional cable with connector.
Figure 12B:
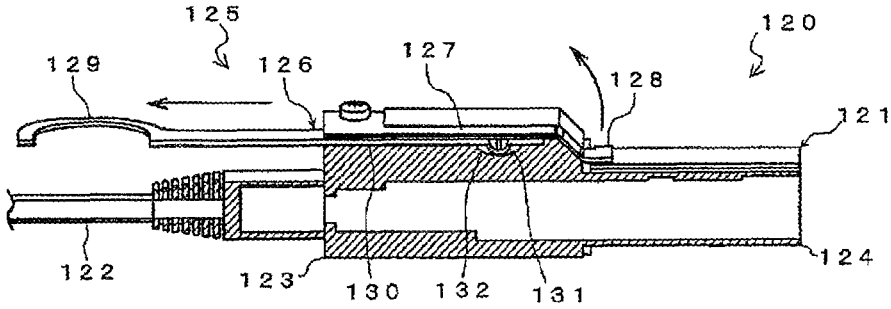
PRIOR ART FIG. 12B
FIG. 12B is a longitudinal cross-sectional view of the cable with connector shown in FIG. 12A.

In the conventional latch structure 120 explained in FIGS. 12A and 12B, the connector 121 is attached and detached while pulling the lever part 129 so that it is necessary to carry out the work with both hands, however, in the latch structure 6 according to the embodiment, the connector 4 can be attached and detached only by pushing down the cover body 9 from above so that the work can be carried out with one hand and the connector 4 can be easily attached and detached.

In addition, in the conventional latch structure 120, in order to pull the lever part 129, it is needed for the lever part 129 to project to the rear ward of the connector body 123, however, in the latch structure 6, the engagement is released by pushing the cover body 9 from above so that it is not needed for the cover body 9 to project to the rear ward of the connector body 2. Consequently, it does not have a problem that the appearance becomes complicated as the case of the conventional latch structure 120 so that the latch structure 6 and the cable with connector 1 having a good appearance can be realized.

Further, the latch cover 7 is formed of a single plate material so that the number of parts can be reduced and the latch structure 6 can be formed at low cost without forming a complicated axis holding mechanism or the like.

Furthermore, the upper surface of the connector body 2 is formed to be diagonally inclined and the rocking of the latch cover 7 is restricted at the position that the cover body 9 becomes horizontal, so that the latch cover 7 and the connector body 2 can have an almost rectangular parallelepiped shape as a whole. Consequently, the connector 4 is able to satisfy the shape and dimension defined by MSA.

Hereinafter, Examples according to the invention will be explained.

Figure 6:
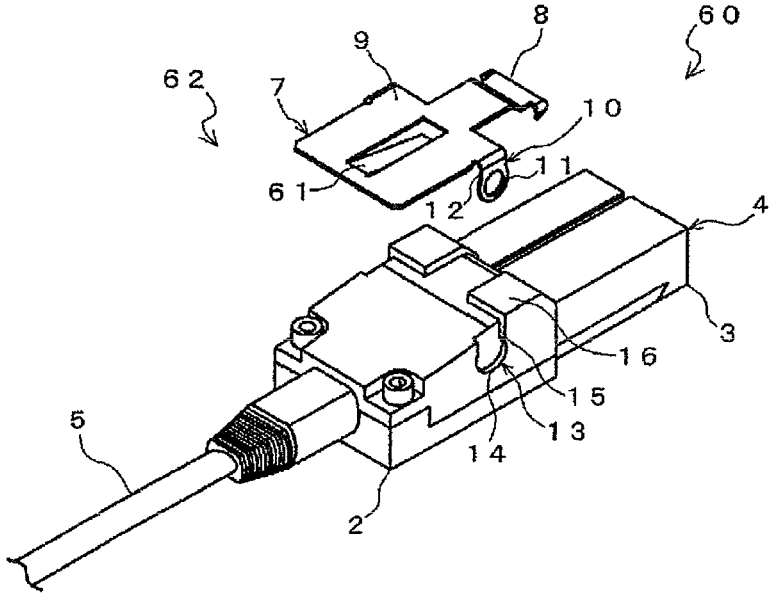
FIG. 6 is a perspective view schematically showing a cable with connector having a latch structure according to another embodiment of the invention.

A cable with connector 60 shown in FIG. 6 includes a latch structure 62 according to the invention that uses a plate spring 61 integrally formed with the cover body 9 and energizing upward the cover body 9 located behind the rocking member 10 as a spring member, in the cable with connector 1 shown in FIG. 1A.

The plate spring 61 is formed by forming a cut in a U shape in a center portion of the cover body 9 and bending downward a part of the cover body 9 surrounded by the cut, and it is formed so as to be inclined downward from the rear to the front of the cover body 9.

As a plate material used for the latch cover 7, it is preferable to use a material less likely to be deformed by permanent deformation (plastic deformation) since a part thereof is used for a spring member (the plate spring 61), and for example, a spring material of stainless-steel is preferably used.

According to the latch structure 62, the plate spring 61 of a spring member can be also integrally formed as the latch cover 7 so that the number of parts can be further reduced and the latch structure 62 can be formed at low cost.

Figure 7A:
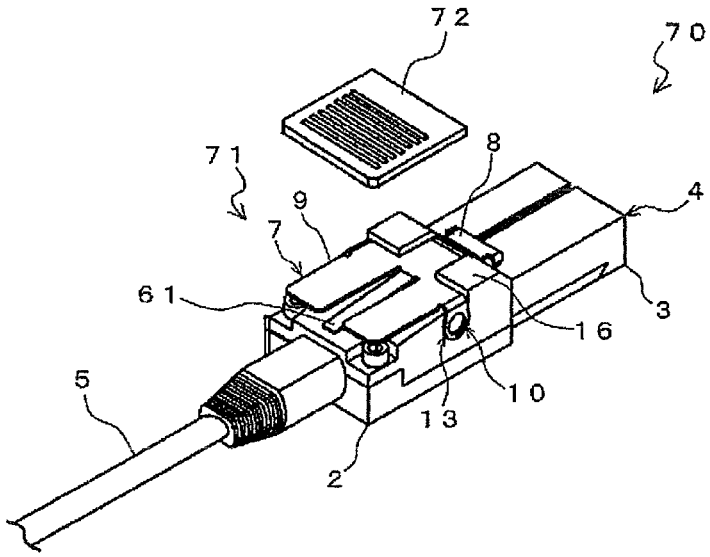
FIG. 7A is a perspective view schematically showing the cable with connector shown in FIG. 6 before a plate with slip stopper is mounted.
Figure 7B:
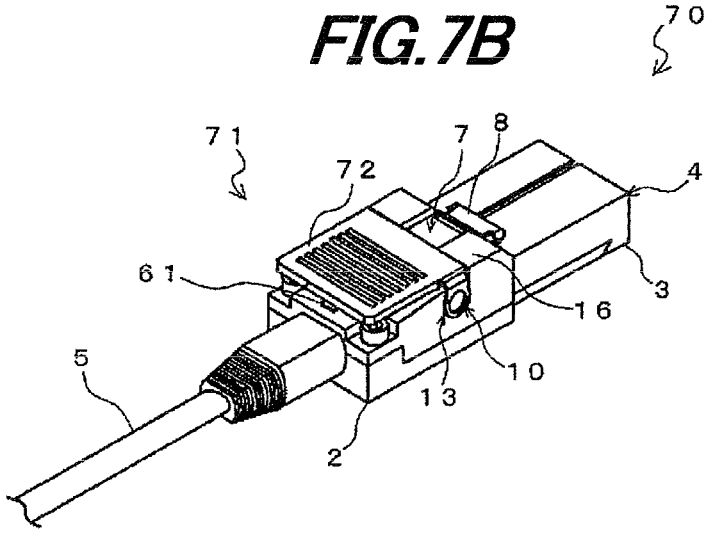
FIG. 7B is a perspective view schematically showing the cable with connector shown in FIG. 6 after the plate with slip stopper is mounted.

A cable with connector 70 shown in FIGS. 7A and 7B includes a latch structure 71 according to the invention in which a plate spring 61 is formed so as to be inclined downward from the rear to the front and the plate with slip stopper 72 is mounted on the upper surface of the cover body 9 of the latch cover 7, in the cable with connector 60 shown in FIG. 6.

The plate spring 61 is formed by forming two cuts in parallel from a center portion to a rear end portion of the cover body 9 and bending downward a part of the cover body 9 surrounded by the cut, and it is formed so as to be inclined downward from the front to the rear of the cover body 9.

According to the latch structure 71, similarly to the cable with connector 60 shown in FIG. 6, the plate spring 61 can be integrally formed as the latch cover 7 so that the number of parts can be reduced and further, the plate with slip stopper 72 is mounted so that the cover body 9 can be easily pushed when the connector 4 is attached and detached, and fingers can be prevented from slipping at the pushing.

Figure 8A:
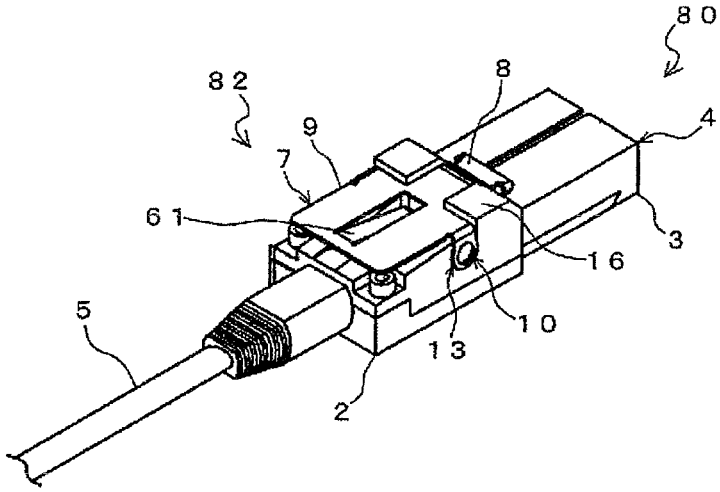
FIG. 8A is a perspective view schematically showing a cable with connector having a latch structure according to another embodiment of the invention.
Figure 8B:
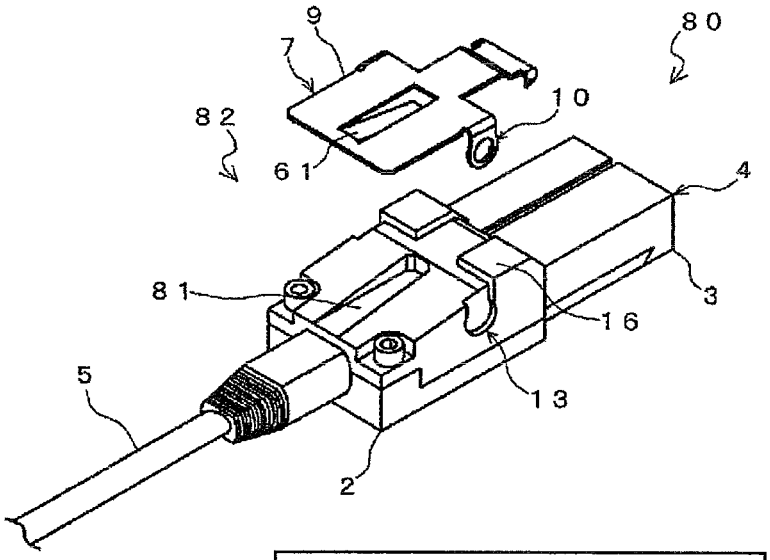
FIG. 8B is an exploded perspective view of the cable with connector shown in FIG. 8A.

A cable with connector 80 shown in FIGS. 8A and 8B includes a latch structure 82 according to the invention in which a plate spring housing groove 81 for housing the plate spring 61 is formed on the upper surface of the connector body 2, in the cable with connector 60 shown in FIG. 6.

Due to forming the plate spring housing groove 81, the plate spring 61 can be restricted to move right and left, so that rattling of the latch cover 7 can be prevented and the latch structure 82 having further stability can be realized.

Figure 9A:
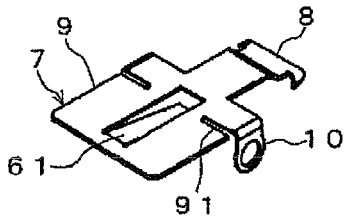
FIG. 9A is a perspective view schematically showing a latch cover used for a latch structure according to one modification of the invention.

In the above-mentioned cable with connectors 1, 60, 70 and 80, the rocking member 10 of the latch cover 7 in a state of being expanded is fitted to the rocking groove 13, but there is concern that the latch cover 7 is deformed by plastic deformation when the rocking member 10 is expanded. In response to this, as shown in FIG. 9A, it can be adopted that slits 91 are formed at the base of the rocking member 10 of the cover body 9 so as to prevent the plastic deformation of the latch cover 7.

Figure 9B:
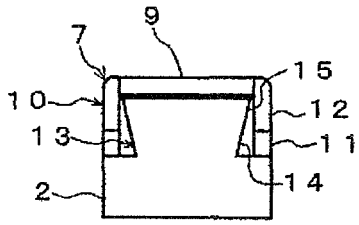
FIG. 9B is a transverse cross-sectional view schematically showing the cable with connector having the latch structure according to one modification of the invention.

However, if the plastic deformation still occurs, as shown in FIG. 9B, it can be adopted that the whole of the rocking groove 13 is formed so as to be interiorly inclined toward the lower portion, and after the latch cover 7 is installed, the rocking member 10 is pushed into the inside, so that the deformation of the latch cover 7 is recovered.

Figure 10:
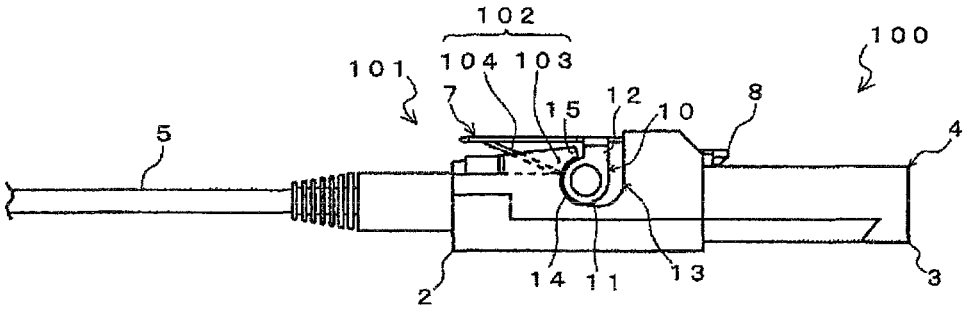
FIG. 10 is a side view schematically showing a cable with connector having a latch structure according to another embodiment of the invention.

A cable with connector 100 shown in FIG. 10 includes a latch structure 101 according to the invention in which the circular plate axis 11 is formed so as to be eccentric backward to a center axis of the supporting leg 12 (left side in FIG. 10 and a rear end side of the connector body 2) and the axis groove 14 is formed so as to be eccentric backward to the groove for pivot 15, and the groove for pivot 15 is formed to have a width into which the circular plate axis 11 is inserted from above, so that the circular plate axis 11 is housed in the axis groove 14 via the groove for pivot 15, in the cable with connector 60 shown in FIG. 6.

The latch structure 101 includes a stopper mechanism 102 for holding the circular plate axis 11 of the latch cover 7 in the axis groove 14. The stopper mechanism 102 is used for preventing rattling of the latch cover 7 and preventing the latch cover 7 from being detached from the connector body 2.

The stopper mechanism 102 includes a stopper groove 103 formed on the upper surface of the connector body 2 and a plate spring 104 integrally formed with the cover body 9, engaging with the stopper groove 103 so as to latch the latch cover 7 backward and energizing upward the cover body 9 located behind the rocking member 10. The plate spring 104 has two functions as a spring member for energizing the cover body 9 upward and a stopper for latching the latch cover 7 rearward in order that the latch cover 7 is not detached from the connector body 2.

Figure 11A:
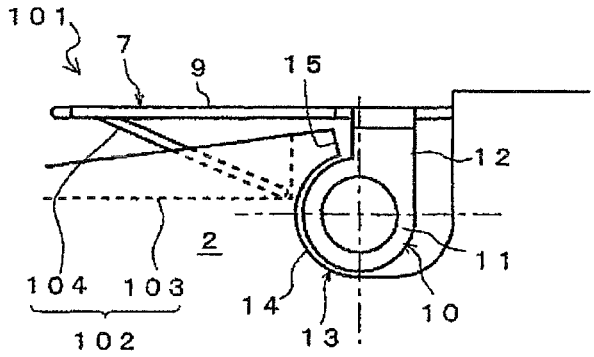
FIG. 11A is an enlarged side view of the primary portion of the cable with connector shown in FIG. 10.

In the latch structure 101, as shown in FIG. 11A, the cover body 9 of the latch cover 7 is always energized upward by the plate spring 104 so that the cover body 9 is always located at the position that the cover body 9 becomes horizontal. In addition, the plate spring 104 always latches the latch cover 7 rearward, so that the circular plate axis 11 is held in the axis groove 14. Due to this, the latch cover 7 is prevented from being detached from the connector body 2 via the groove for pivot 15.

Figure 11B:
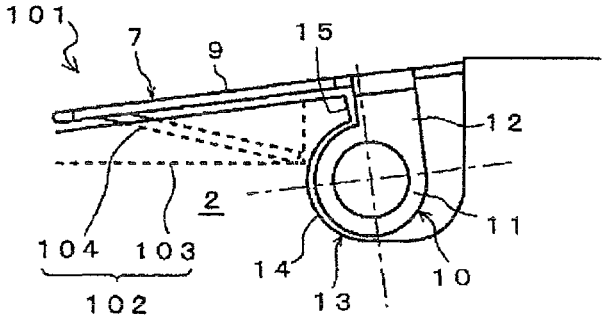
FIG. 11B is an enlarged side view of the primary portion of the cable with connector shown in FIG. 10.

As shown in FIG. 11B, when the cover body 9 of the latch cover 7 is pushed down from above, the latch cover 7 rocks around the circular plate axis 11 (in a counterclockwise direction in FIG. 11B), consequently, the engagement claw 8 is lifted upward, and the connector 4 can be attached to and detached from the cage 31.

In the latch structure 101, the latch cover 7 is installed in the connector body 2 by that the circular plate axis 11 is housed in the axis groove 14 via the groove for pivot 15. Consequently, the rocking member 10 is not needed to be expanded when the latch cover 7 is attached to the connector body 2, so that the latch cover 7 can be easily attached to the connector body 2 without deforming the latch cover 7 by the plastic deformation.

In the above-mentioned embodiment, a case that one coil spring 21 or one plate spring 61, 104 is installed as a spring member was explained, but a plurality of the spring members can be also installed. Additionally, in the above-mentioned embodiment, a case that the spring member is installed in the center portion of the cover body 9 was explained, but not limited to this, for example, it can be installed in both of the side end portions of the cover body 9. In this case, it is preferable that the plate spring housing groove 81 or the stopper groove 103 is formed corresponding to the plate spring 61, 104.

Also, in the above-mentioned embodiment, a case that the circular plate axis 11 has a circular plate-like shape was explained, but not limited to this, for example, it can have a semicircular shape or a polygonal shape.

Further, in the above-mentioned embodiment, a case that the rocking of the latch cover 7 is restricted by the rocking restriction part 16 at the position that the cover body 9 becomes horizontal was explained, but, not limited to this, for example, another case that the rocking restriction part 16 is omitted, and the engagement claw 8 butts against the insertion part 3 of the connector 4 at a position that the cover body 9 becomes horizontal, and the rocking of the latch cover 7 is restricted by the insertion part 3 can be also adopted.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A latch structure for attachably and detachably holding a connector in a cage, the connector comprising a connector body having an almost rectangular parallelepiped shape and an insertion part formed on a front end surface of the connector body so as to be inserted in the cage, and the cage having an engagement hole, the connector body having an upper surface, a lower surface opposing the upper surface and opposite side surfaces extending from the upper surface to the lower surface, the latch structure comprising:

a latch cover rockably installed on the upper surface of the connector body, being formed of a single plate material and having a cover body for covering the upper surface of the connector body;

an engagement claw formed at an end portion of the latch cover and located over the front end surface of the connector body so as to engage with the engagement hole of the cage;

a spring member for always energizing the latch cover so that the engagement claw engages with the engagement hole;

rocking members formed on either side of the cover body of the latch cover and formed by bending the plate material downward, the rocking members being located between the engagement claw and a rear portion of the cover body along a longitudinal direction of the connector;

rocking grooves formed in the opposite side surfaces of the connector body for rockably engaging with the rocking members, wherein each of the rocking members is fitted to each rocking groove such that the latch cover is rockably installed on the connector body; and a rocking restriction part for restricting the rocking of the latch cover at a position when the cover body is horizontally oriented, the rocking restriction part being formed at an end portion of the upper surface of the connector body, wherein an inclined region of the upper surface of the connector body is formed to be diagonally inclined so as to be lowered in height toward a rear end portion of the connector body, the inclined region extends from the rocking grooves to the rear end portion of the connector body, wherein a distance between the upper surface and the lower surface at the rear end portion of the connector body is less than a distance between the upper surface and the lower surface at the rocking grooves, and wherein the latch cover and the connector body have a substantially rectangular parallelepiped shape as a whole when the engagement claw engages with the engagement hole.

2. The latch structure according to claim 1, wherein the spring member is integrally formed with the cover body and formed of a plate spring energizing upward the rear portion of the cover body, the rear portion of the cover body being located behind the rocking members.

3. The latch structure according to claim 1, wherein each rocking member is formed of a circular plate axis to become a rocking axis of the latch cover and a supporting leg connecting the circular plate axis and the latch body, and each rocking groove is formed of an axis groove for rotatably housing the circular plate axis and a groove for rotatably housing the supporting leg, and the circular plate axis is housed in the axis groove and the supporting leg is housed in the groove so that the latch cover is rockably installed on the connector body.

4. A cable assembly comprising:

the connector comprising the latch structure is connected to according to claim 1; and a cable connected to the connector.

5. The latch structure according to claim 1, wherein the rocking members are located behind the engagement claw.

6. The latch structure according to claim 1, wherein the engagement claw comprises a protrusion protruding downwardly.

7. The latch structure according to claim 2, wherein the spring member maintains a downward force at the engagement claw.

8. The latch structure according to claim 1, wherein the latch cover comprises the cover body provided over the upper surface of the connector body and each of the rocking members extending toward a respective one of the opposite side surfaces of the connector body.

9. The latch structure according to claim 1, wherein the rear portion of the cover body is configured to be pressed downward for attaching and detaching the connector from the cage.

10. The latch structure according to claim 1, wherein, when the engagement claw is engaged with the engagement hole, a gap between the upper surface and the latch cover is greater at the rear end portion of the connector body than a gap between the upper surface and the latch cover at a front end portion of the connector body.

* * * * *

UNITED STATES PATENT AND TRADEMARK OFFICE

CERTIFICATE OF CORRECTION

PATENT NO. : 8,905,442 B2
APPLICATION NO. : 12/643358
DATED : December 9, 2014
INVENTOR(S) : Yoshiaki Ishigami et al.

It is certified that error appears in the above-identified patent and that said Letters Patent is hereby corrected as shown below:

Delete title page and substitute the attached title page therefor.

In the Claims
It Should Read:
COLUMN 10, line 39

Claim 11: The latch structure according to claim 3, wherein the circular plate axis is formed so as to be eccentric backward to a center axis of the supporting leg and the axis groove is formed so as to be eccentric backward to the groove, and the groove is formed to have a width into which the circular plate axis is inserted from above, so that the circular plate axis is housed in the axis groove via the groove for pivot.

Claim 12: The latch structure according to claim 11, wherein the latch structure further comprises a stopper mechanism for holding the circular plate axis of the latch cover in the axis groove.

Claim 13: The latch structure according to claim 12, wherein the stopper mechanism comprises a stopper groove formed on the upper surface of the connector body, and a plate spring integrally formed with the cover body, engaging with the stopper groove so as to latch the latch cover backward and energizing upward the rear portion of the cover body, the rear portion of the cover body being located behind the rocking member.

Signed and Sealed this
Eleventh Day of August, 2015

Michelle K. Lee

Michelle K. Lee
*Director of the United States Patent and Trademark Office*

(12) United States Patent
Ishigami et al.

(10) Patent No.: US 8,905,442 B2
(45) Date of Patent: Dec. 9, 2014

(54) LATCH STRUCTURE AND CABLE WITH CONNECTOR

(75) Inventors: Yoshiaki Ishigami, Hitachi (JP); Kenichi Tamura, Hitachi (JP); Masayuki Nikaido, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 860 days.

(21) Appl. No.: 12/643,358

(22) Filed: Dec. 21, 2009

(65) Prior Publication Data

US 2010/0194119 A1 Aug. 5, 2010

(30) Foreign Application Priority Data

Jan. 30, 2009 (JP) ..... 2009-020716

(51) Int. Cl.

| | |
|---|---|
| ***E05C 19/10*** | (2006.01) |
| ***H01R 13/639*** | (2006.01) |
| *H01R 13/627* | (2006.01) |

(52) U.S. Cl.

CPC ..... *H01R 13/627* (2013.01); *H01R 13/639* (2013.01); *Y10S 292/63* (2013.01)

USPC .... 292/128; 292/228; 292/304; 292/DIG. 63; 439/352

(58) Field of Classification Search

USPC ..... 398/135–139; 439/155, 160, 350, 352, 439/358, 752; 292/101, 107, 108, 120, 128, 292/80, 87, 89, 91, 213, 218, 228, 303, 304, 292/DIG. 30, DIG. 61, DIG. 63

See application file for complete search history.

(56) References Cited

U.S. PATENT DOCUMENTS

| | | | | |
|---|---|---|---|---|
| 1,899,360 | A * | 2/1933 | Roudebush et al. | 439/358 |
| 4,726,783 | A * | 2/1988 | Nakazawa et al. | 439/350 |
| 5,011,425 | A * | 4/1991 | Van Zanten et al. | 439/353 |
| 5,340,329 | A * | 8/1994 | Hirai | 439/357 |
| 5,383,794 | A * | 1/1995 | Davis et al. | 439/352 |
| 5,713,752 | A * | 2/1998 | Leong et al. | 439/358 |
| 5,741,150 | A * | 4/1998 | Stinson et al. | 439/358 |
| 5,788,528 | A * | 8/1998 | Orr et al. | 439/358 |

(Continued)

FOREIGN PATENT DOCUMENTS

| | | |
|---|---|---|
| JP | 2004-311207 | 11/2004 |
| JP | 2004-343506 | 12/2004 |

*Primary Examiner* — Kristina Fulton
*Assistant Examiner* — Alyson M Merlino
(74) *Attorney, Agent, or Firm* — Scully, Scott, Murphy & Presser, P.C.

(57) ABSTRACT

A latch structure according to an embodiment includes a cage having an engagement hole, a connector attachably and detachably held in the cage, the connector comprising a connector body having an almost rectangular parallelepiped shape and an insertion part to be inserted into the cage formed on an end surface of the connector body, a latch cover rockably installed in an upper surface of the connector body, being formed of a single plate material and having a cover body for covering the upper surface of the connector body, an engagement claw to engage with the engagement hole of the cage formed at an end portion of the latch cover, a spring member for always energizing the latch cover so that the engagement claw engages with the engagement hole, a rocking member formed in both sides of the cover body of the latch cover and formed by bending the plate material downward and a rocking groove formed in both side surfaces of the connector body for rockably engaging with the rocking member, wherein the rocking member is fitted to the rocking groove and the latch cover is rockably installed in the connector body.

13 Claims, 11 Drawing Sheets

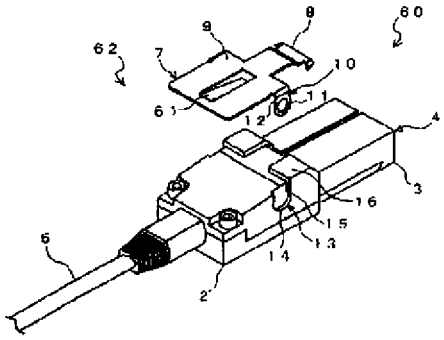

60 CABLE WITH CONNECTOR
61 PLATE SPRING
62 LATCH STRUCTURE